US008464876B2

(12) United States Patent
Ozaki et al.

(10) Patent No.: US 8,464,876 B2
(45) Date of Patent: Jun. 18, 2013

(54) BANKNOTE HANDLING APPARATUS

(75) Inventors: Hirofumi Ozaki, Shinagawa-Ku (JP); Osamu Ito, Kawaguchi (JP)

(73) Assignee: Glory Ltd., Himeji-Shi (JP)

( * ) Notice: Subject to any disclaimer, the term of this patent is extended or adjusted under 35 U.S.C. 154(b) by 0 days.

(21) Appl. No.: 13/281,613

(22) Filed: Oct. 26, 2011

(65) Prior Publication Data

US 2012/0041590 A1 Feb. 16, 2012

Related U.S. Application Data

(63) Continuation of application No. 12/444,038, filed as application No. PCT/JP2006/320120 on Oct. 6, 2006, now Pat. No. 8,074,806.

(51) Int. Cl.
*B07C 5/00* (2006.01)

(52) U.S. Cl.
USPC ..... 209/534; 194/206; 194/207

(58) Field of Classification Search
USPC ..... 209/534, 551; 194/206, 207; 902/12, 902/13, 17
See application file for complete search history.

(56) References Cited

U.S. PATENT DOCUMENTS

| | | | | |
|---|---|---|---|---|
| 3,976,198 | A | 8/1976 | Carnes et al. | |
| 4,905,839 | A | 3/1990 | Yuge et al. | |
| 4,905,840 | A | 3/1990 | Yuge et al. | |
| 6,601,687 | B1 | 8/2003 | Jenrick et al. | |
| 6,604,636 | B2 | 8/2003 | Sallen et al. | |
| 6,771,180 | B2 | 8/2004 | Mizuta et al. | |
| 6,880,692 | B1 | 4/2005 | Mazur et al. | |
| 6,929,109 | B1 | 8/2005 | Klein et al. | |
| 7,048,108 | B1 * | 5/2006 | Yellop et al. | 194/317 |
| 7,232,204 | B2 | 6/2007 | Mazur et al. | |
| 7,269,279 | B2 * | 9/2007 | Chiles | 382/135 |
| 8,074,806 | B2 * | 12/2011 | Ozaki et al. | 209/534 |
| 2005/0241909 | A1 | 11/2005 | Mazur et al. | |

FOREIGN PATENT DOCUMENTS

| | | | |
|---|---|---|---|
| DE | 101 17 822 | A1 | 10/2002 |
| GB | 2 038 290 | A1 | 7/1980 |
| JP | 03-111991 | A1 | 5/1991 |
| JP | 04-284590 | A1 | 10/1992 |
| JP | 05-052970 | U1 | 7/1993 |
| JP | 2006-190125 | A1 | 7/2006 |

* cited by examiner

*Primary Examiner* — Joseph C Rodriguez
(74) *Attorney, Agent, or Firm* — Burr & Brown

(57) ABSTRACT

A banknote handling apparatus including a receiving unit that receives banknotes to be counted, a recognition unit that recognizes attributes of the banknotes, a storing unit that stores the banknotes sorted based on a recognition result by the recognition unit, an operation unit for selecting a counting mode and a setting for stacking, and a verification counting process control unit that executes a first counting process when the operation unit selects a verification mode as the counting mode, stores the banknotes in stacking units in a designated first setting for stacking, executes a verification counting process to the banknotes stacked in the first setting for stacking, stores the banknotes in stacking units in a designated second setting for stacking that is different from the first setting for stacking, and determines match/mismatch of the number of banknotes of each denomination in the first counting process and the verification counting process.

6 Claims, 5 Drawing Sheets

BANKNOTE HANDLING APPARATUS

CROSS REFERENCE TO RELATED APPLICATIONS

This application is a continuation of U.S. application Ser. No. 12/444,038 filed Apr. 2, 2009, which was the National Stage of International Application No. PCT/JP2006/320120 filed Oct. 6, 2006, the entireties of which are incorporated herein by reference.

FIELD OF THE INVENTION

The present invention relates to a banknote handling apparatus, and particularly, to a banknote sorting machine including a verification counting process mode.

BACKGROUND OF THE INVENTION

One of the banknote handling apparatuses that execute various types of processes related to banknotes is a banknote sorting machine that sorts the banknotes by denomination. Some of the banknote sorting machines include a verification counting process mode. The verification counting process mode is a mode for recounting the banknotes a plurality of times, which are once counted, in order to ensure the credibility of the counting result.

The verification counting process mode is highly demanded mainly in the pachinko market in Japan and in the casino market in the United States, and the verification process is required by law in some countries.

An example of the banknote handling apparatus with the verification counting process mode includes a technique shown in Japanese Utility Model Laid-Open No. 5-52970.

The technique disclosed in the Utility Model draws attention of the operator by a flashed display of the number of counted banknotes if there is a difference between the number of banknotes set by means for setting the number of banknotes and the number of banknotes actually counted.

SUMMARY OF THE INVENTION

The verification counting process mode shown in the Utility Model simply alarms the difference between the counting results, and it is unreasonable to apply the concept to the banknote sorting machine including a function of sorting a multiplicity of types of banknotes.

The present invention focuses on the fact that the same target banknotes are processed for a plurality of times (usually twice) in the verification counting process. An object of the present invention is to provide a banknote handling apparatus including a plurality of stacking units, the banknote handling apparatus being capable of improving the reliability of the counting result, obtaining a desired sorted state after the verification counting process, and having improved convenience.

According to the present invention, there is provided a banknote handling apparatus a banknote handling apparatus comprising:

a receiving unit that receives banknotes to be counted;

a recognition unit that recognizes attributes including denominations of the banknotes to be counted imported from the receiving unit;

a storing unit that stores the banknotes sorted based on a recognition result by the recognition unit in accordance with a setting for sorting;

an operation unit that can select a counting mode and a setting for stacking; and a verification counting process control unit that imports the banknotes to be counted to execute a first counting process when the operation unit selects a verification mode as the counting mode, stores the banknotes in the plurality of stacking units in a designated first setting for stacking, executes a verification counting process to the banknotes stacked in the first setting for stacking, stores the banknotes in the plurality of stacking units in a designated second setting for stacking that is different from the first setting for stacking, and determines match/mismatch of the number of banknotes of each denomination in the first counting process and the verification counting process.

According to the banknote handling apparatus, changing the setting for stacking for a plurality of stacking units between a first counting process and a verification counting process can efficiently use the stacking result in the first counting process, thereby simplifying the processing of banknotes and improving the credibility in counting.

DETAILED DESCRIPTION OF THE INVENTION

Figure 1:
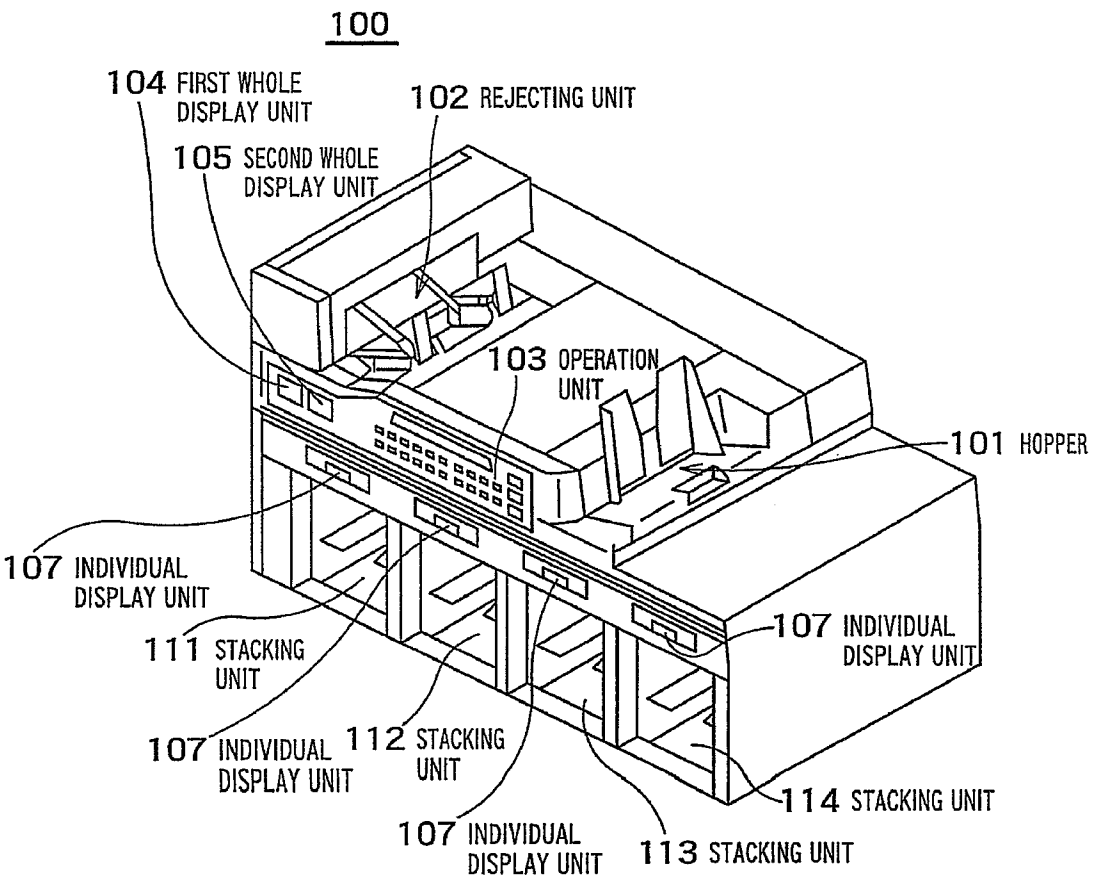
FIG. 1 is a perspective view of an appearance of a banknote handling apparatus according to the present invention.

FIG. 1 is a perspective view of an appearance of a banknote sorting machine 100 as an embodiment of a banknote handling apparatus according to the present invention.

In FIG. 1, on one side of the upper surface, a hopper 101 that imports the banknotes, which are placed in a stacked state, by separation feeding is arranged, and on the other side, a rejecting unit 102 configured to dispense that dispenses the imported banknotes, which are rejected as a result of recognition described below, is arranged.

On the front upper center, an operation unit 103 that selects various processing modes including a verification counting process mode related to the present invention is arranged, and two display units 104 and 105 are arranged adjacent to the operation unit 103. The operation unit 103 includes input keys for the operator to input an instruction.

The display units 104 and 105 display overall information.

On the lower part of the banknote sorting machine 100, stacking units 111 to 114 in which the front surfaces are open so that the sorted banknotes can be easily removed. It is preferable that the number of stacking units corresponds to the number of types of sorted banknotes, and this example includes four stacking units.

On the upper part of the stacking units 111 to 114, individual display units 121 to 124 that display information specific to the stacking units are respectively arranged in correspondence with the stacking units 111 to 114.

Figure 2:
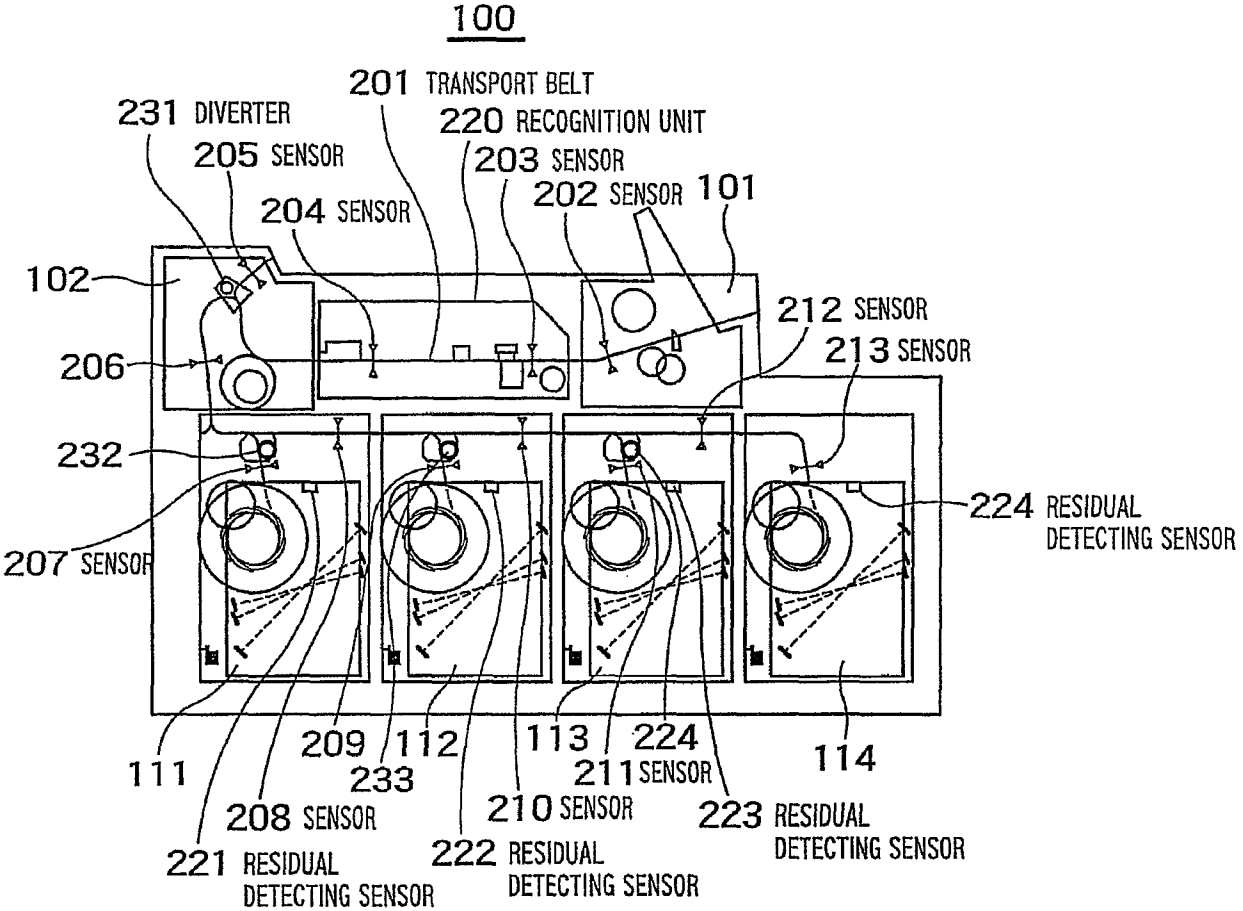
FIG. 2 is a perspective front view of a schematic internal construction of the banknote handling apparatus shown in FIG. 1.

FIG. 2 is a perspective front view of a schematic internal construction of the banknote sorting machine 100 shown in FIG. 1. FIG. 2 mainly illustrates a transport system and a sensor system.

A transport path 201 that transports banknotes from the hopper 101 is formed up to the stacking units. The transport path is usually combined with a belt transport mechanism. Various sensors 202 to 213 are arranged along the transport path. The sensor 202 arranged closer to the outlet of the hopper 101 and the sensor 203 arranged closer to the inlet of the following recognition unit 220 detect whether the banknotes are certainly imported based on the transit time and whether there is no double feeding. The recognition unit 220 includes various detecting parts for detecting fitness, authentication, denomination, orientation, face/back, and the like of the imported banknotes. The representatively shown sensor 204 detects the denomination or authentication by, for example, a transparent sensor based on the light transmittance.

The rejecting unit 102 connected to the recognition unit 220 rejects banknotes removed from the sorting target by the recognition unit 220 by activation of a diverter 231. The sensor 205 detects whether rejected banknotes exist. The banknotes to be sorted are transported while the sensor 206 detects the transport state. Diverters 232, 233, and 234 are properly switched according to the denomination, and the banknotes are stored in relevant stacking units among the stacking units 111 to 114. Residual detecting sensors 221 to 224 detect the storage status of the banknotes.

Figure 3:
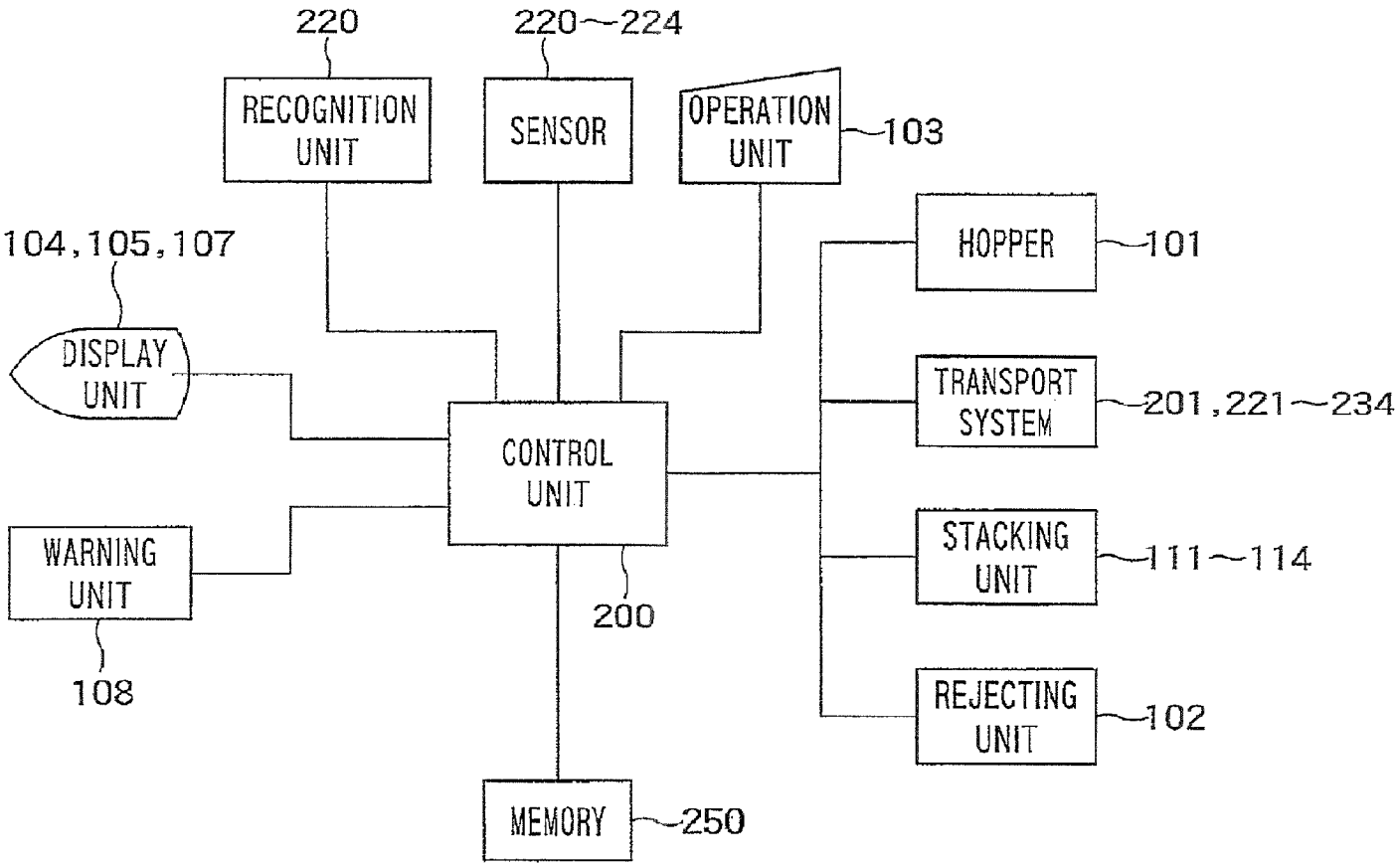
FIG. 3 is a block diagram of the control system of the banknote handling apparatus shown in FIG. 1.

FIG. 3 is a block diagram of the control system in the banknote handling apparatus according to the present invention.

The operation unit 103 for inputting an instruction is connected to a control unit 200 constituted by a microprocessor and the like. Signals from the recognition unit 220 in the device and the sensors 202 to 224 are inputted to the control unit 200.

Based on the instructions and the signals, the control unit 200 can control the hopper 101, the transport systems 201 and 231 to 234, the stacking units 111 to 114, the rejecting unit 102, and the like, display the information necessary for the display units 104, 105, and 107, and issue a warning from the warning unit 108 in response to the generation of an error or the like. A memory 250 that stores necessary programs and calculation results is connected to the control unit 200.

A sorting operation will be described using the above Figures. Japanese banknotes are illustrated as an example, and the stacking units 111 to 114 are allocated to four denominations, 1,000-yen bills (denomination 1), 2,000-yen bills (denomination 2), 5,000-yen bills (denomination 3), and 10,000-yen bills (denomination 4), respectively. The denominations are mixed, and the face/back and the orientations of the banknotes are mixed in the banknotes to be counted that are placed on the hopper 101.

The conventional banknote sorting machine determines the denomination to count the number of banknotes by denomination, returns the banknotes again to the hopper after the first counting process to perform the second counting as a verification counting process, and compares the counting result and the first counting result to check whether there is no error in the denomination and the amount of money.

For this purpose, there can only be one type of stacking unit that stores the counted banknotes as long as the banknotes can be counted by denomination, because the stacking units are not necessary for each denomination.

On the other hand, there are a plurality of stacking units in the invention of the present specification, and the setting for stacking can be changed between the first counting process and the verification counting process. The verification process, in which the setting for stacking is changed, is executed by selecting a mode from various verification modes programmed in advance, which will be described below, and displayed on, for example, the display unit 104 in the operation unit 103.

Figure 4:
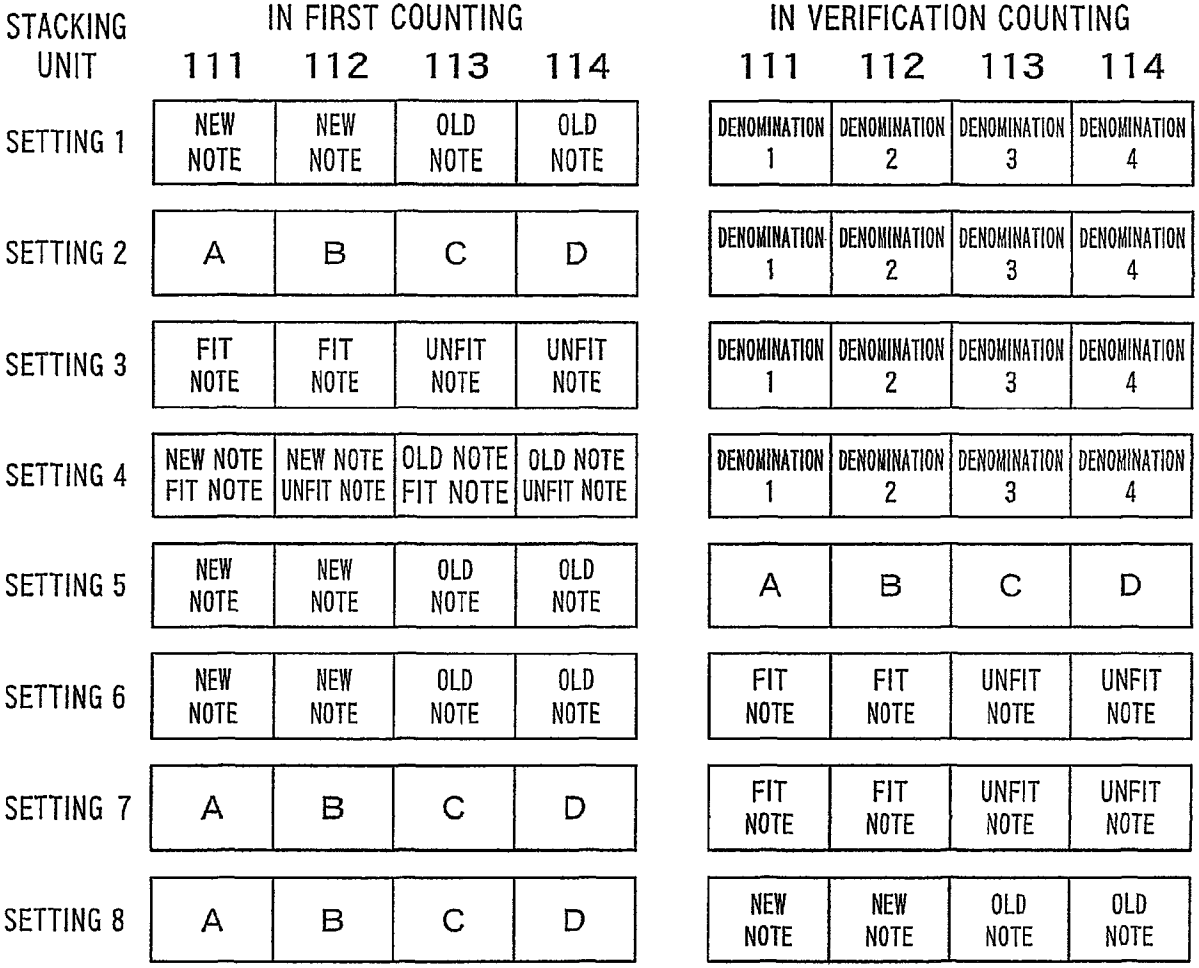
FIG. 4 is a diagram for explaining allocation of the stacking units in the first counting process and the verification counting process in various verification modes.

FIG. 4 is a diagram for explaining allocation of the stacking units in the first counting process and the verification counting process in various verification modes 1 to 8. FIG. 4 illustrates the designation of setting for stacking that can be selected in the first counting on the left side and that can be selected in the verification counting on the right side. The setting for stacking is also designated by the operation unit 103, while the display of the display unit 104 is checked.

First Embodiment

The verification mode 1 in FIG. 4 will be described. In this case, denominations are mixed in the banknotes to be counted, stacking after the first counting is performed by old and new banknotes for the banknotes with changed design, and stacking after the verification counting is performed by denomination. Therefore, the stacking after the first counting is performed by allocating the stacking units 111 and 112 for new banknotes and the stacking units 113 and 114 for old banknotes, the stacking units 111 and 113 are prioritized, and the stacking destinations are changed to the second stacking units 112 and 114 when the stacking units 111 and 113 are full.

When old/new-mixed and mixed denomination banknotes are placed on the hopper 101 and the verification mode 1 is designated and inputted from the operation unit, the banknotes are sequentially sent into the apparatus one by one from the lowest layer by a separated feeding operation. The fitness, authentication, denomination, orientation, and the number of banknotes are checked when the banknotes pass through the recognition unit 220, and obvious counterfeit notes and unidentifiable banknotes are rejected by switching the diverter 231 to the rejecting unit side.

Other banknotes pass through the transport path 201, and the diverters 232 to 234 are switched based on the recognition result in the recognition unit 220. The new banknotes are stacked in the stacking units 111 and 112, and the old banknotes are stacked in the stacking units 113 and 114. An individual display unit arranged on each stacking unit displays the existence of the stacked banknotes and the number of banknotes in each stacking unit in a simple way.

A hopper sensor not shown outputs a no-banknote signal when there are no more banknotes on the hopper. Thereby, the storage unit of the apparatus stores the number of banknotes of each denomination and the total amount of money at this point, and the counting result by denomination is displayed on, for example, the display unit 105 as a first counting result.

After the first counting, the new banknotes are stacked in the stacking units 111 and 112, and the old banknotes are stacked in the stacking units 113 and 114. Therefore, the old and new banknotes are not mixed within the stacking units.

Next, the verification counting process is executed. The banknotes removed from the stacking units 111 to 114 are placed on the hopper 101. Then, the counting starts again. As described, during the verification counting process, the stacking units 111 to 114 are allocated to four denominations, 1,000-yen bills, 2,000-yen bills, 5,000-yen bills, and 10,000-yen bills, respectively.

As with the first counting, the hopper 101 feeds out the banknotes, and the recognition unit 220 checks the fitness, authentication, denomination, orientation, and the number of banknotes. The diverters 232 to 234 are switched based on the denomination to stack the banknotes in the stacking units 111 to 114 corresponding to the denominations. A hopper sensor (not shown) outputs a no-banknote signal when there are no more banknotes on the hopper 101. Thereby, the storage unit in the apparatus stores the number of banknotes of each denomination and the amount of money at this point, and the display unit 105 displays the verification counting result. The display unit 105 also displays the first counting result and a message related to match and mismatch.

When the verification counting process is finished, the new banknotes are stacked on the lower side and the old banknotes are stacked on the upper side in each stacking unit for each denomination.

Figure 5:
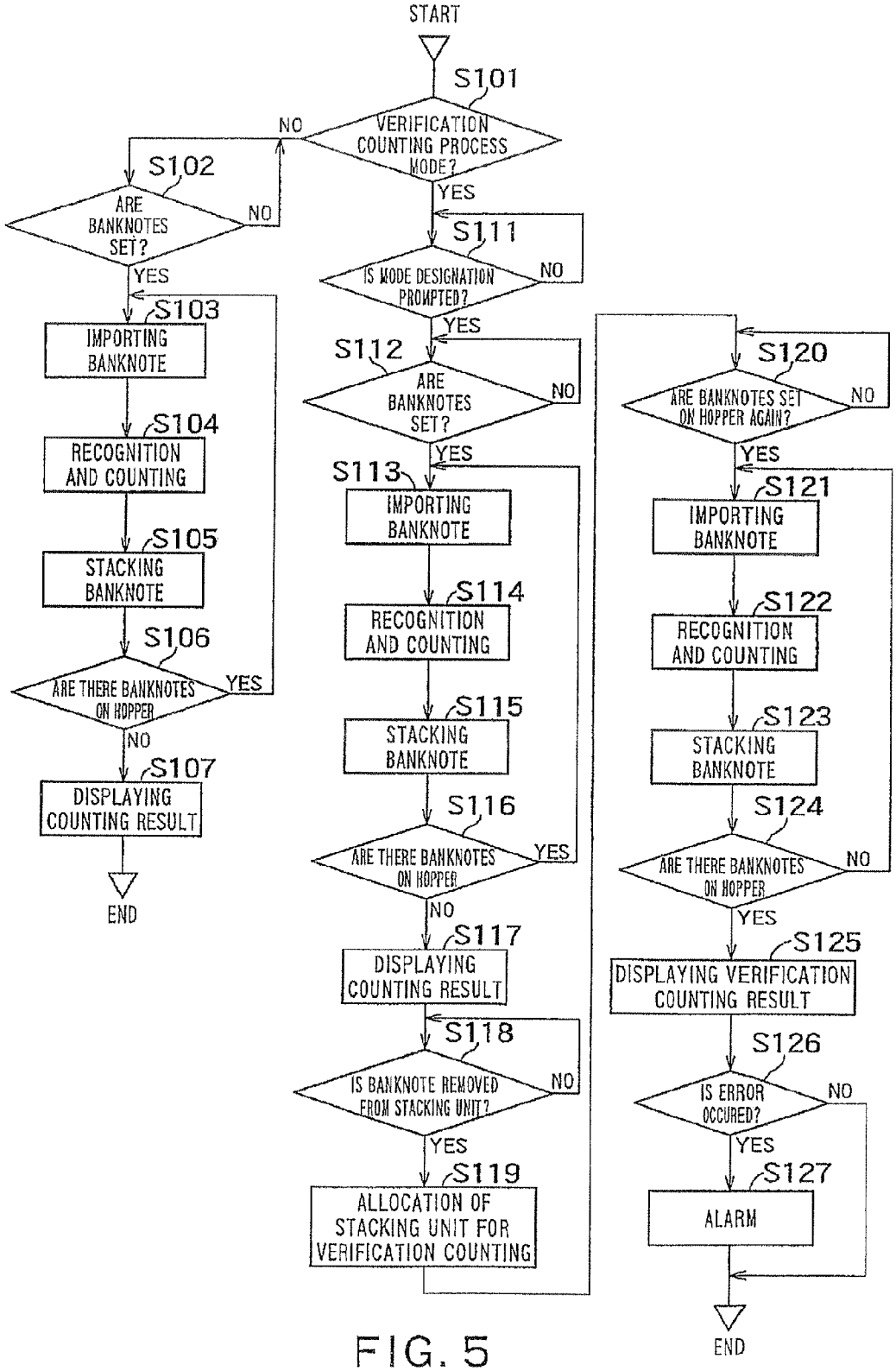
FIG. 5 is a flow chart showing details of the counting process operation in the banknote handling apparatus according to the present invention.

FIG. 5 is a flow chart, in which the above operations are organized, showing details of the counting process operation in the banknote sorting machine according to the present invention.

First, the operation unit accepts a designation input indicating a normal counting process mode or a verification counting process mode (step S101).

In the case of the normal counting process, whether the banknotes are set in the hopper is checked (step S102), the banknotes are imported after the banknotes are set (step S103), the imported banknotes are recognized and counted (step S104), and the banknotes are stacked in the stacking units (step S105). When there are no more banknotes to be counted in the hopper, the counting result is displayed, and the process ends.

On the other hand, in the case of the verification counting process, the mode designation is prompted before the start of counting (step S111), and the way the banknotes are stacked in the stacking units is set according to the designated mode after the designation. When the banknotes are set in the hopper (step S112), importing of the banknotes is started (step S113), the banknotes are recognized and counted (step S114), and the banknotes are stacked in appropriate stacking units according to the recognition result (step S115). When there are no more banknotes to be counted in the hopper (step S116), the counting result is displayed (step S117), and a message prompting to again place the banknotes of the stacking units on the hopper is displayed on, for example, the display unit.

In accordance with the message, whether the banknotes are removed is checked (step S118), and if the removal is confirmed, the allocation of the stacking units for the verification counting is performed (step S119). If the stacking units are set for each orientation in the first counting process, placing the stacking units in the same orientation on the hopper for the verification counting can arrange the banknotes to be counted in the same orientation.

When the placement of the banknotes on the hopper is confirmed (step S120), the verification counting process is started by pressing of a start button (not shown) or with automatic start by a timer, and the banknotes are imported (step S121). The way the banknotes are stacked in the stacking units is already changed at this point. Therefore, based on the recognition result in the recognition unit (step S122), the banknotes are stacked to the stacking units (step S123).

When there are no more banknotes to be counted in the hopper (step S124), the verification counting result is displayed in addition to the first counting result. On that occasion, match/mismatch with the first counting result is displayed. Especially, the mismatch (step S126) is determined as an error, and the display is flashed, or attention is drawn such as by the sound of alarm sound (step S127).

Second Embodiment

This embodiment illustrates the verification mode 2 in FIG. 4, and banknotes with mixed denominations are counted.

In the following embodiments, the placement to the hopper 101, import, and recognition, the storage to the stacking units, and the like are the same as in the first embodiment. Therefore, detailed description will be omitted, and modes of stacking to the stacking units will be mainly described.

In the verification mode 2, in the first counting, the denominations and the number of banknotes are checked, four kinds of combinations of face/back and upright/inverted are judged, and the banknotes are stacked in the stacking units 111 to 114 allocated for the combinations. In the following description, these four cases may be collectively called "orientation". Thus, the case of face and upright is defined as "A", the case of back and upright is defined as "B", the case of face and inverted is defined as "C", and the case of back and inverted is defined as "D". After the first counting process, the face/back and upright/inverted are organized in the stacking units. Therefore, in the verification counting process if all banknotes are placed so that the upper sides of the banknotes are face and upright, all banknotes have the same orientation in the verification counting process. In the second embodiment, in the verification counting process, four denominations, which are 1,000-yen bills, 2,000-yen bills, 5,000-yen bills, and 10,000-yen bills, are allocated to the stacking units 111 to 114 respectively. Therefore, after the verification counting process, four stacked batches with organized denominations and orientation are obtained.

Third Embodiment

The verification mode 3 in FIG. 4 is illustrated, and banknotes with mixed denominations are counted.

In this mode, the banknotes are sorted by fitness in the first counting, and the banknotes are stacked by denomination in the verification counting.

The mode is convenient to efficiently sort the banknotes to remove banknotes with problems in the circulation.

Fourth Embodiment

The verification mode 4 in FIG. 4 is illustrated, and the banknotes with mixed denominations are counted.

In this mode, the banknotes are sorted into four combinations of old/new and fitness in the first counting. Therefore, for example, the stacking unit 111 stacks new and fit banknotes, the stacking unit 112 stacks new and unfit banknotes, the stacking unit 113 stacks old and fit banknotes, the stacking unit 114 stacks old and unfit banknotes, and the banknotes are stacked by denomination in the verification counting. Thus, if the stacked banknotes in the stacking units 111 to 114 in the first counting are sequentially subjected to the verification counting, the new and fit banknotes, the new and unfit banknotes, the old and fit banknotes, and the old and unfit banknotes are sequentially stacked from the bottom of the stacking units of each denomination. As a result, handling after the verification counting process is facilitated.

Fifth Embodiment

The verification mode 5 in FIG. 4 is illustrated, and the banknotes already sorted by denomination are counted in the following embodiments 5 to 7.

In this mode, the banknotes are sorted by old/new in the first counting and stacked by orientation in the verification counting.

Sixth Embodiment

The verification mode 6 in FIG. 4 is illustrated.

In this mode, the banknotes are sorted by old/new in the first counting and are stacked by fitness in the verification counting.

Seventh Embodiment

The verification mode 7 of FIG. 4 is illustrated.

In this mode, the banknotes are stacked by orientation in the first counting, and the banknotes are placed in the same orientation and stacked by fitness in the verification counting. As a result, the banknotes in the same orientation and fitness can be easily obtained.

Eighth Embodiment

The verification mode 8 in FIG. 4 is illustrated.

In this mode, the banknotes are stacked by orientation in the first counting, and the banknotes are placed in the same orientation and stacked by old/new in the verification counting. As a result, the banknotes in the same orientation and old/new can be easily obtained.

Although the banknote handling apparatus according to the invention of the present specification has been described by explaining some of the embodiments, the present invention is not limited by the embodiments.

For example, the number of stacking units is not limited to four as in the embodiments, but may be more or less. It is usually preferable that the number of stacking units matches the number of types of banknotes to be sorted.

The allocation of the stacking units shown in the embodiments is also examples, and arbitrary combinations are possible. Registering the combinations in advance as verification modes allows selecting the combinations at the start of processing.

We claim:

1. A banknote handling apparatus comprising:

a receiving unit that receives banknotes;

a recognition unit that recognizes attributes of the banknotes that have been imported from the receiving unit;

a plurality of stacking units that sort and stack the banknotes sorted based on a recognition result by the recognition unit in accordance with a setting for stacking;

an operation unit that selects a mode for processing the banknotes a plurality of times; and a control unit that imports the banknotes to execute a first sorting process when the operation unit selects the mode, stacks the banknotes in the plurality of stacking units in accordance with a first setting for stacking, executes a second sorting process on the banknotes stacked in accordance with the first setting for stacking, and stacks the banknotes in the plurality of stacking units in accordance with a second setting for stacking that is different from the first setting for stacking.

2. The banknote handling apparatus according to claim 1, wherein the recognition unit recognizes, at least, fitness.

3. The banknote handling apparatus according to claim 1, wherein the control unit counts the number of the banknotes and determines match/mismatch of the number of banknotes in the first sorting process and the second sorting process.

4. The banknote handling apparatus according to claim 1, wherein the control unit sets the second setting for stacking when the removal of the banknotes from the stacking units is confirmed after the first sorting process stacks the banknotes in the stacking units in accordance with the first setting for stacking.

5. The banknote handling apparatus according to claim 1, wherein the receiving unit receives the banknotes stacked in the stacking units in accordance with the first setting for stacking when the receiving unit is prompted and there are no banknotes in the receiving unit from the first sorting process.

6. The banknote handling apparatus according to claim 1, wherein the control unit counts the number of the banknotes, and a counting result of the banknotes from the first sorting process and a counting result of the banknotes from the second sorting process are displayed when there are no more banknotes in the receiving unit from the second sorting process.

* * * * *